US005511350A

United States Patent [19]

Nivens

[11] Patent Number: 5,511,350

[45] Date of Patent: Apr. 30, 1996

[54] BLOCK WALL SYSTEM

[76] Inventor: Kirk N. Nivens, Lot 4A, Seabrook Point, Seabrook, S.C. 29940

[21] Appl. No.: 387,449

[22] Filed: Feb. 13, 1995

Related U.S. Application Data

[63] Continuation of Ser. No. 147,293, Nov. 15, 1993, abandoned.

[51] Int. Cl.[6] ..... C02D 27/00

[52] U.S. Cl. ..... 52/293.3; 52/295; 52/437; 52/609; 405/284

[58] Field of Search ..... 52/293.1, 293.2, 52/293.3, 295, 437–439, 604–609, 611, 612, 592.6; 405/284, 285, 286

[56] References Cited

U.S. PATENT DOCUMENTS

| | | | |
|---|---|---|---|
| 1,424,372 | 8/1922 | Neese | 52/609 |
| 1,687,342 | 10/1928 | MacVeigh | 52/605 |
| 1,785,499 | 12/1930 | Sayers | 52/437 |
| 1,807,138 | 5/1931 | Spelshouse | 52/437 |
| 2,134,637 | 10/1938 | Loucks | 72/41 |
| 2,323,661 | 7/1943 | Hosbein | 52/604 |
| 3,309,832 | 3/1967 | Filsinger | 52/605 |
| 3,549,115 | 12/1970 | Williams | 249/33 |
| 3,802,134 | 9/1974 | McCorvey | 52/93 |
| 3,848,376 | 11/1974 | Elmore | 52/169 |
| 4,473,985 | 10/1984 | Hunt | 52/593 |
| 4,608,795 | 9/1986 | Neuschaeffer et al. | 52/612 X |
| 4,621,476 | 11/1986 | MacGregor | 52/741 |
| 4,909,010 | 3/1990 | Gravier | 52/604 |
| 5,120,164 | 6/1992 | Iacocca et al. | 405/284 |
| 5,154,542 | 10/1992 | Klenert | 405/286 |
| 5,214,898 | 6/1993 | Beretta | 52/606 |
| 5,367,845 | 11/1994 | Hartling | 52/293.1 |

*Primary Examiner*—Carl D. Friedman
*Assistant Examiner*—Winnie Yip

[57] ABSTRACT

A block wall system is presented for use in building construction whereby a foundation wall can be quickly and economically prepared for a metal or other type building. A unique top wall block which has a notched face section and a laterally offset horizontal support section for retaining floor joists or concrete slabs form the upper row of the wall.

16 Claims, 2 Drawing Sheets

BLOCK WALL SYSTEM

This is a continuation of application Ser. No. 08/147,293 filed Nov. 5, 1993 now abandoned.

BACKGROUND OF THE INVENTION

1. Field of the Invention

The invention herein pertains to concrete block wall systems and particularly to building foundation walls which utilize a novel block design in the construction.

2. Description of the Prior Art and Objectives of the Invention

Various foundation wall systems have been utilized in the past in which concrete footings are poured and block walls constructed having a top "cap" block. Past construction of buildings using siding or preformed panels with concrete slab floors has required the wall siding or panels to either extend below the floor level with bottom flashings and seals, or the concrete floor slab is formed on-site to provide a ledge on which the siding or panels rest. On-site or "field" forming of concrete and control of deflection in concrete forms is labor intensive and requires special care to control quality, resulting in high costs. On-site forms for concrete must be disposed of or be stripped, cleaned and oiled prior to their subsequent use which also requires additional labor and expense.

In U.S. Pat. No. 3,549,115 an on-site poured concrete floor having a notch along the upper front edge for positioning a monolithic wall therein is shown. U.S. Pat. No. 3,802,134 also illustrates a foundation having an upper wall receiving notch. U.S. Pat. No. 5,154,542 demonstrates an earth retaining module which will interlock with similar modules for providing a stabilizing wall system.

None of the prior art systems described above demonstrate a block wall system as described herein and these previous systems fail to teach the structure and advantages of the present invention. The invention herein allows the construction of buildings without on-site concrete form work being required to provide the flashing notch, to tie the foundation wall to the floor slab, or to form the floor slab, offering substantial reduction in construction costs as compared to prior construction techniques.

Thus, with the present disadvantages and problems associated with prior art block wall systems, the present invention was conceived and one of its objectives is to provide a precast wall block and block system which is economical for contractors and building owners.

It is another objective of the present invention to provide a wall system which can be adapted to many varieties of construction styles and techniques.

It is another objective of the present invention to provide a wall block which includes a face section having an upper flashing notch and a support section affixed thereto for retaining a concrete slab or other floor member thereon.

It is yet another objective of the present invention to provide a wall block which can be readily formed from concrete and which includes a support section which is laterally offset to insure proper mating by a mason during wall construction.

It is yet still another objective of the present invention to provide a wall block which can be mass produced at a factory and conveniently delivered to a job site for use by a mason in constructing foundation walls.

Various other objectives and advantages of the present invention will become apparent to those skilled in the art as a more detailed description is set forth below.

SUMMARY OF THE INVENTION

The invention herein pertains to a foundation wall system and particularly to a foundation wall system whereby the upper or top row utilizes a novel concrete block which includes a face with a support section formed therewith. The support section has a lesser height for supporting a floor member while the face section includes an upper notch for receiving an exterior building wall as may be formed from corrugated metal or the like. The wall system includes a base comprising a ground poured concrete footing with the desired number of rows of conventional concrete blocks placed thereon. Atop the conventional concrete blocks are blocks of the invention as will be further described herein having a notched face section and a rearwardly extending support section which is offset to provide structural integrity during the building process.

DESCRIPTION OF THE PREFERRED EMBODIMENTS

Figure 1:
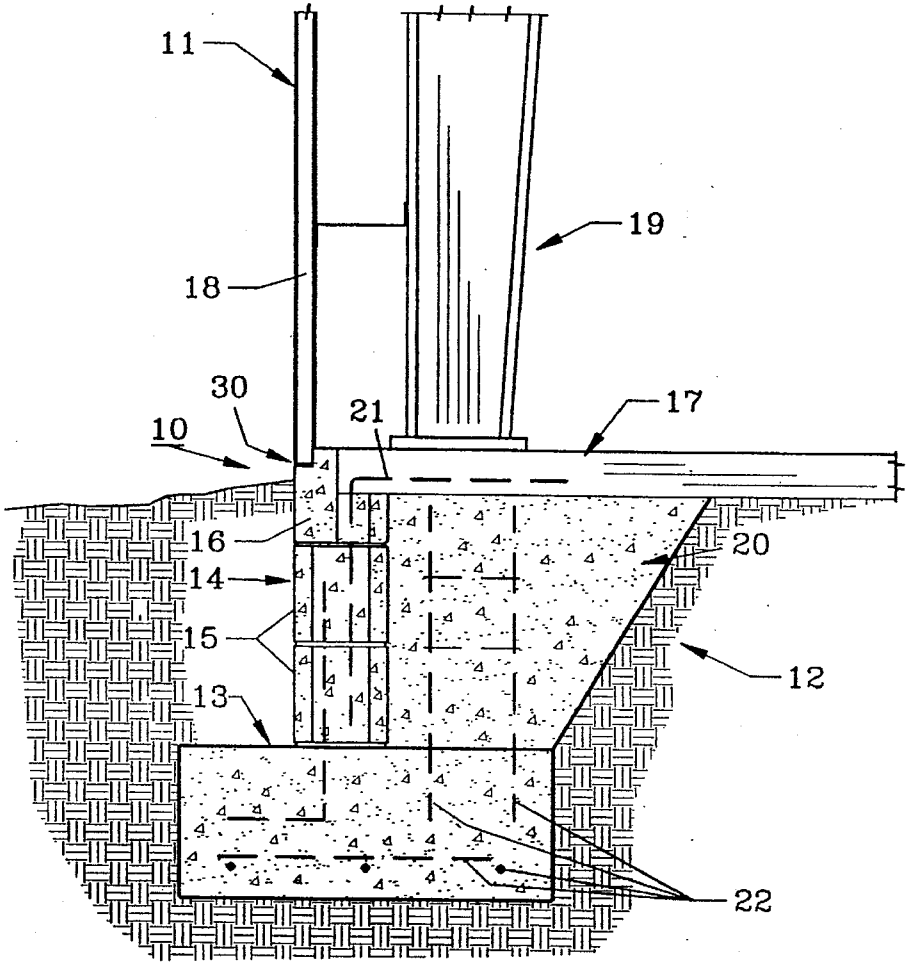
FIG. 1 illustrates a typical use of the wall system of the invention with a foundation wall showing the use of the novel wall block herein.
Figure 3:
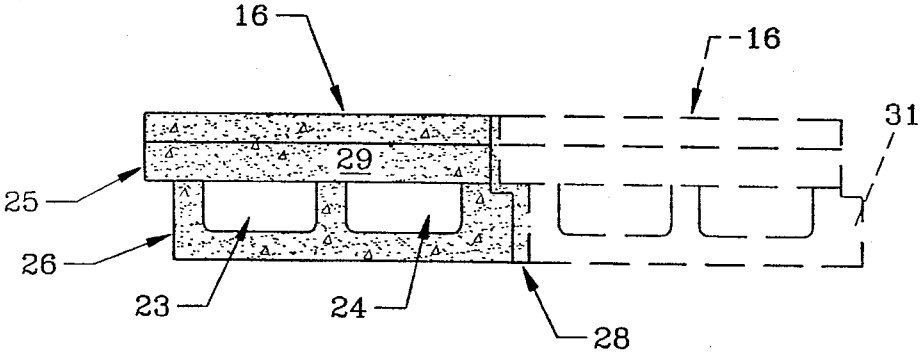
FIG. 3 pictures a top view of the block of FIG. 2 with a second such block shown in ghost fashion as positioned in a wall.

The preferred wall system of the invention is shown in FIG. 1 whereby a concrete base is formed by a footing poured on-site and a relatively low block wall formed of two rows of conventional concrete blocks positioned thereon. Atop the conventional blocks are a row of concrete blocks of the invention which are interlocked during construction with conventional mortar cement by a mason as illustrated at FIG. 3. An exterior building wall is placed in the upper front notch and is tied to an internal vertical column. Additional concrete may be poured on-site between the foundation wall and the earth if necessary with reinforcing bars added to improve the structural integrity immediately below the internal vertical column. A floor member such as a concrete slab or a wooden floor joist is positioned on the upper wall block of the invention and reinforcing bars inserted in block channels to improve the structural rigidity between the floor member and the foundation wall.

The upper block of the foundation wall as shown in FIG. 1 is seen enlarged in FIGS. 2–7 which demonstrates an upper notch in the face section and a shorter, rearward extending support section having a pair of vertical channels which is laterally offset from the face section and includes a horizontal extension to improve mating with adjacent blocks during wall construction. The concrete blocks of the invention as shown are formed at a factory and delivered to the job site where they are laid with conventional masonary tools and cement. The wall construction using such blocks has proven to be efficient and economical while providing the desired structural integrity.

DETAILED DESCRIPTION OF THE DRAWINGS AND OPERATION OF THE INVENTION

For a better understanding of the invention and its operation, turning now to the drawings, FIG. 1 illustrates foundation block wall system 10 for building 11 having a base consisting of concrete footing 13 and having an exterior foundation wall 14 positioned thereon. Foundation wall 14 consists of two rows of conventional concrete blocks 15 which are laid with mortar joints as is standard practice in the trade. Various numbers of rows of conventional blocks 15 may be used, depending on the particular building and/or site. Atop blocks 15 wall block 16 of the invention is shown as will hereinafter be more fully explained. Floor member 17 rests on wall block 16 and may be for example a wooden floor joist, a concrete floor slab or the like. Exterior outside building wall 18 may be preformed from metal such as aluminum, steel, wood, synthetics or otherwise and also rests on wall block 16 in notch 30. Concrete footing 13 is poured in place in ground 12 as is usual practice in the building trade. Concrete pile 20 with standard steel reinforcing bars 22 is shown atop footing 13 for supporting floor member 17. Concrete pile 20 may be for example eighteen inches in width. Positioned vertically above pile 20 is internal vertical building column 19 which is formed from structural steel. L-shaped steel tie rod 21 is attached to floor member 17 and passes through channel 23 of block 16 as seen in FIG. 3. As further shown in FIG. 1, tie rod 21 passes through wall block 16 and also through the channels formed in conventional concrete blocks 15. All such channels are filled with concrete during construction to insure a rigid assembly. As would be understood by those skilled in the art, the particular structure shown in FIG. 1 is but one of many types that could employ block 16 and wall system 10.

Wall block 16 is of unique design and allows a foundation wall to be quickly and conveniently completed. Wall block 16 is specially designed inter-mating reinforced or non-reinforced modular block which can be used to eliminate the field forming of concrete floor slabs below, at, or above existing site grades. Block 16 allows the integral reinforcement connection of foundation wall 14 and floor member 17 while providing a self-flashing edge into which exterior wall 18 or other panel can be placed. When used alone or in conjunction with present art masonry blocks, block 16 allows the placement of elevated concrete slabs without perimeter field forming.

Figure 6:
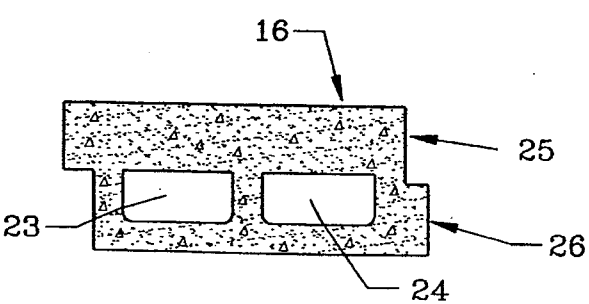
FIG. 6 illustrates a bottom view of the wall block as shown in FIG. 2.
Figure 5:
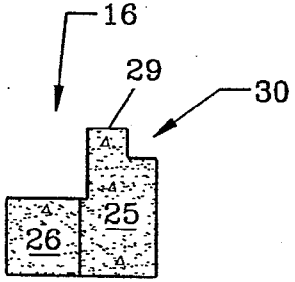
FIG. 5 depicts a left end view of the block as shown in FIG. 2.

Block 16 consists of face section 25 and support section 26 attached thereto as shown in FIGS. 2–6. Assembly of block 16 into a wall is shown in FIG. 3 demonstrating a pair of blocks 16 and includes mortar joint 28 therebetween. As would be understood, face section 25 shown at FIG. 7 and support section 26 of block 16 are cast or formed in a specially designed single mold from concrete as are conventional concrete wall blocks 15. Support section 26 has a height of approximately four inches whereas the overall height of face section 25 as shown in FIG. 5 is seven and five-eighths inches. This differential of three and five-eighths inches allows for floor member 17 to be formed and placed therein with its upper surface flush with block top surface 29. The front upper edge of face section 25 of block 16 defines a notch 30 which allows exterior building wall 18 to rest therein as shown in FIGS. 1, 5 and 6. Notch 30 has a height of one and one-half inches and a depth of one and one-half inches to accommodate most metal building exterior walls which may be insulated, corrugated or the like.

Figure 7:
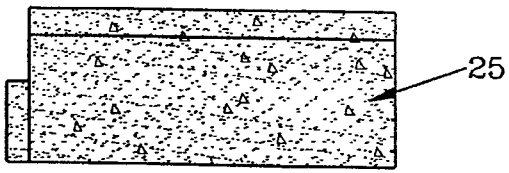
FIG. 7 presents a front view of the wall block as seen in FIG. 4.
Figure 2:
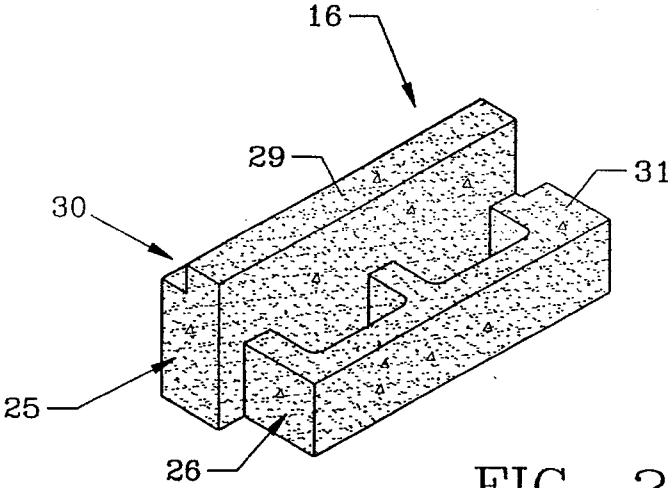
FIG. 2 demonstrates a perspective right end, top and rear view of the novel wall block as used in FIG. 1.
Figure 4:
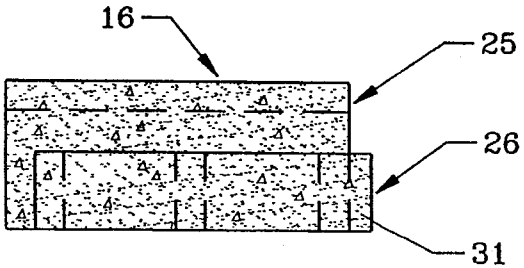
FIG. 4 shows a rear elevational view of the block as shown in FIG. 2.

It should be noted that support section 26 as seen in FIGS. 2, 3 and 7 is offset horizontally or laterally behind face section 16. This offset accommodates horizontal extension 31 as shown in FIGS. 2–4. Horizontal extension 31 extends laterally one and one-eighths inches beyond face section 25 to increase the integrity of block wall system 10 as featured in FIG. 1. As further shown in FIGS. 2 and 3, horizontal extension 31 likewise has a lesser depth than support section 26. The depth of horizontal extension 31 may be for example only three and five-eighths inches whereas the depth of support section 26 may be four and one-eighth inches as illustrated in FIGS. 3, 5 and 6. Also, as earlier explained, the height of support section 26 is substantially less than the overall height of face section 25 to which it is formed to accommodate floor member 17. The length of face section 25 may be for example seventeen and five-eighths inches long whereas the length of support section 26 may be only seventeen and one-quarter inches long, including horizontal extension 31 to account for the mortar joist. The depth of face section 25 may be three and one-half inches whereas the depth of support section 26 is greater, for example four and one-eighth inches. Other sizes and dimensions of block 16 may also be formed.

The top view of wall block 16 as shown in FIG. 3 and a bottom view thereof is shown in FIG. 6 illustrating channels 23, 24 which are formed to improve handling convenience by making the block lighter for economy in manufacturing and to allow L-shaped tie rods 21 as shown in FIG. 1 to pass therethrough after which concrete or the like can be used to fill channels 23, 24 for structural improvement.

Various other sizes of wall block 16 can be manufactured and other materials other than concrete can be used for molding wall block 16 of the invention. The illustrations and examples shown herein are merely for explanatory purposes and are not intended to limit the scope of the appended claims.

I claim:

1. A construction wall top block of uniform composition comprising: a face section, said face section having rear, front, top, bottom, and first and second side surfaces, a support section, said .support section defining a vertical channel, said channel extending the entire height of said support section, said support section having rear, front, top, bottom, and first and second side surfaces, the longitudinal length of said support section less than the longitudinal length of said face section, said front surface of said support section joined to said rear surface of said face section, said first side surface of said support section flush with said first side surface of said face section, a horizontal extension, said horizontal extension longitudinally extending from said first side surface of said support section and having a depth less than the depth of said support section, said bottom surface of said support section flush with said bottom surface of said face section, said support section having a height less than said face section wherein said first side surface of said face section, said first side surface of said support section and said horizontal extension for complementary reception of second side surfaces of an adjacent wall top block.

2. A construction wall block as claimed in claim 1 wherein said face section defines a notch along one edge.

3. A construction wall block as claimed in claim 2 wherein said notch is defined along the front upper edge of said face section.

4. A construction wall block as claimed in claim 1 wherein said bottom surface of said face section and said bottom surface of said support section are flat.

5. A construction wall block as claimed in claim 1 wherein said support section defines a channel.

6. A construction wall block as claimed in claim 5 wherein said channel is defined vertically in said support section.

7. A construction wall block as claimed in claim 1 wherein said support section defines a plurality of channels.

8. A concrete wall top block of uniform composition comprising: a face section, said face section having first and second ends, said face section also having rear, front, top and bottom surfaces, a support section, said support section having a height less than said face section, said support section and said rear surface of said face section defining a vertical channel, said channel extending the entire height of said support section, said support section having first and second ends and a longitudinal length from said first end to said second end less than the longitudinal length from said first end to said second end of said face section, said support section having its bottom. Surface flush with the bottom surface of said face section, said support section joined to said face section along the longitudinal length of said face section, said support section parallel to said face section, said first end of said support section flush with said first end of said face section, a horizontal extension, said horizontal extension extending from said first end of said support section wherein said first end of said face section, said first end of said support section and said horizontal extension complement a second end of an adjacent wall top block.

9. A foundation wall system for a building comprising: a base, at least first and second pre-cast concrete top wall blocks of uniform composition positioned to complement one another on said base, each of said wall blocks comprising a face section, said face section having rear, front, top, bottom, and first and second side surfaces, said front surface defining a notch along the top edge, said notch having a horizontal and a vertical surface, a relatively short support section, said support section having rear, front, top, bottom, and first and second side surfaces, said support section defining a vertical channel, said channel extending the entire height of said support section, the longitudinal length of said support section of each of said blocks being less than the longitudinal length of said face section, said front surface of said support section joined to the rear of said face section, said first side surface of said support section flush with said first side surface of said face section, a horizontal extension, said horizontal extension having a depth less than the depth of said support section, said horizontal extension extending from said first side surface of said support section, wherein said second side surfaces of said second block are complementally received by the first side surfaces of said adjacently positioned first block.

10. The wall system of claim 9 including a floor member, said floor member positioned on said top surfaces of said support sections wherein said floor member contacts the rear surfaces of said face sections.

11. The wall system of claim 10 wherein each of said support sections define a vertical channel, and including a tie rod, said tie rod positioned in said vertical channel of said support section of said first wall block.

12. The wall system of claim 11 including concrete, said concrete received in said vertical channel to form a solid walls system.

13. The wall system of claim 9 wherein said base comprises a concrete footing.

14. The wall system of claim 9 wherein said base comprises a block wall.

15. The wall system of claim 9 and including an exterior building wall, said building wall received within said notches.

16. The wall system of claim 13 wherein said floor member comprises a concrete slab.

* * * * *